United States Patent [19]

Ballstadt

[11] Patent Number: 5,014,471

[45] Date of Patent: May 14, 1991

[54] EXTRUDED MOLDING FOR GLASS BLOCK STRUCTURES

[76] Inventor: George Ballstadt, 4850 Richmond Ave., Fremont, Calif. 94536

[21] Appl. No.: 332,297

[22] Filed: Mar. 31, 1989

[51] Int. Cl.[5] ..... E04C 3/04

[52] U.S. Cl. ..... 52/98; 52/308; 52/477

[58] Field of Search ..... 52/738, 720, 97, 211, 52/217, 308, 477, 98–100, 397–402, 300, 239–242, 588; 49/504, 482; 403/401, 402

[56] References Cited

U.S. PATENT DOCUMENTS

| | | | |
|---|---|---|---|
| 2,141,000 | 12/1938 | Hohl | 52/308 |
| 2,282,964 | 5/1942 | Hohl | 52/241 |
| 3,140,763 | 7/1964 | Edelstein | 52/397 |
| 3,345,794 | 10/1967 | Proud | 52/739 |

FOREIGN PATENT DOCUMENTS

| | | | |
|---|---|---|---|
| 1498010 | 1/1978 | United Kingdom | 52/738 |

*Primary Examiner*—James L. Ridgill, Jr.

*Attorney, Agent, or Firm*—Bielen, Peterson, Lampe

[57] ABSTRACT

An extruded molding configured to frame glass masonry block for building structures, particularly wood frame structures, the molding having a flat base portion on which the block is seated and raised side elements forming a channel with breakaway spacer elements to accommodate block of different width, the molding in an exterior embodiment having a weather flash and as nailing flange to prevent water seepage under the molding, and in an interior embodiment having coupling members for coupling a cap for finishing edges of exposed glass block structures.

16 Claims, 2 Drawing Sheets

EXTRUDED MOLDING FOR GLASS BLOCK STRUCTURES

BACKGROUND OF THE INVENTION

This invention relates to specially configured extruded moldings for use with glass block building materials. In particular, the extruded moldings provide the perimeter trim for glass block structures, especially where mortared glass block are set in wood frame structures.

The recent popularity of glass block for exterior walls, windows, room dividers and other more innovative structures has provided new challenges in integrating the masonry structures into existing or new buildings. Because of the increased use of glass block in home building, particular methods of adaptation must be employed since home building is largely of wood frame construction.

Since glass block structures are not load bearing and are extensively used for external windows and wall sections, the glass block structure must be encased by a means that prevents water intrusion. Prior to this invention, a simple sheet metal channel has been employed around the perimeter of the glass block structure as an interface between the masonry materials and conventional wood framing. While the channel isolates the glass block masonry structure from the wood frame, it does not prevent water from seeping under the channel resulting in damage to the supporting wood structure.

Additionally, the increased use of glass block in interior design has resulted in structures that are innovative, such as glass wall partitions, low rising dividers, door transoms, and walk-way walls and the like. Frequently, the glass block wall structure must be incorporated into the frame construction building by a means that is both functional and attractive. Since most interior walls are constructed with two by four studs that are covered with sheet rock, an attractive trim that can be interposed between the glass block structure and the framing wall is desirable. In certain instances, the top or side of a glass block structure is exposed and requires capping. An interface member that is straight and uniform is preferred both as a finish molding or as a seat for a specialty molding such as a hardwood rail or the like. The direct contact of wood materials to masonry structures is preferably to be avoided. Furthermore, a molding member that can accommodate glass block of the two different standard widths would be useful in both interior and exterior environments.

These and other conditions in the construction of glass block structures have presented certain difficulties requiring more adequate solutions. Molding that is specially designed to masonry block would be useful to the construction industry. The extrusion moldings invented have been devised to solve the problems of incorporating glass blocks structures into new and existing buildings, particularly buildings that are of wood frame construction.

SUMMARY OF THE INVENTION

The uniquely configured extruded moldings of this invention comprise specialty trims for seating and framing glass masonry block of different widths in both interior and exterior environments.

The extruded molding devised for the exterior environment includes a weather flashing and a nailing flange which combine to prevent seepage of water behind the molding. Seepage of water invariably results in damage to the structure supporting or framing a glass block masonry structure. The exterior molding devised both isolates the masonry structure from direct contact with the frame structure and secures the molding to the frame structure by a means that insures weather proofing.

The extruded molding devised for the interior environment provides a uniform wall board trim and includes a novel coupling means for coupling a capping member when the molding is used for an exposed edge of a glass block structure.

Both the exterior and interior moldings have means for seating glass block of the two conventional widths against the moldings. The moldings are useful for masonry buildings or wood buildings and are particularly designed as an attractive encasement trim where the trim serves a functional as well as ornamental purpose.

The extruded moldings are preferably of an inexpensive and non-corrosive metal such as aluminum which may be finished with an anodized or coated surface as is customary for aluminum glazing extrusions. The moldings preferably are fabricated in standard rigid lengths, for example, twenty feet, and have a uniform cross section along its length. The cross section for purposes of description is divided into multiple elements, but it is to be understood that the elements are integrally formed as a unitary structure during formation of the extrusion.

The interior and exterior moldings are formed with a wide, flat, base element with outside edges having perpendicular, flat, side elements projecting from a seating surface on the side of the base element that abuts the glass block structure. The base element and side elements form a channel. At least one of the side elements has at its distal end a perpendicular spacer element that is directed toward the opposite side element to restrict the opening of the channel. The spacer element can be knocked off the end of the side element of the molding to accommodate the larger size block. The base element is sufficiently wide to accommodate the width of the larger size block when seated within the channel against an insulation pad of fiberglass or closed cell foam.

The opposite side of the base element has a backing surface that includes at least two raised ribs or rail members which have a bore to allow mitered ends of common molding to be fastened together by self threading screws during assembly of an encasement frame. The raised rail members provide stiffening to the moldings and a support surface that interfaces the building structure. The rail members raise the backside of the base element from the framing structure of the building to eliminate any possibility of capillary action from water seepage. By use of the moldings, a pre-formed encasement can be constructed which forms a straight uniform border for the block structure and an accurate guide for block placement during assembly of the block wall structure.

The exterior molding includes in addition to the common elements described, a weather flashing formed of a substantially perpendicular flat flash element projecting outwardly from one of the side elements. The flat flash element may be inclined to form a drip sill, but is preferably perpendicular, since the molding is usable for encasing the sides and top of a block structure as well as the bottom of the structure. The exterior molding also includes a nailing flange formed of a flange element arranged perpendicular to the flash element extending from the backing surface in the same plane as of the proximate side element. The flange element together with the flash element prevent water from seepage under the molding.

The interior molding includes in addition to the common elements described, coupling members that enable the coupling of a cover or cap to the molding to provide a finished edge for the top or side of a block structure. The cover or cap is an extrusion that may be different configurations designed to function as a finish piece, or in other instances as a seat piece for a wood overlay, a base for a railing, or a variety of other uses that will become apparent to the imaginative designer. It is to be understood that the interior molding is usable outside, particularly when used for finishing an exposed top or edge of a glass block wall or rail.

When used for interior casements, the interior molding provides a neat trim to sheetrock walls by the incorporation of a narrow sill element projecting outwardly from the ends of the side elements and an outer trim element parallel to the side element which is positioned to overlap the edge of a sheetrock sheet.

The extrusions of this invention provide the builder with the necessary materials for efficient and attractive encasement and trim of glass block masonry structures in both interior and exterior environments.

FIG. a cross sectional view of the interior molding in a typical building structure.

Figure 4:
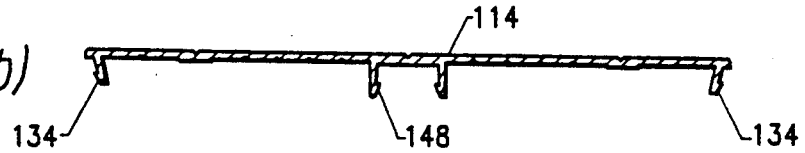
Figure 4:
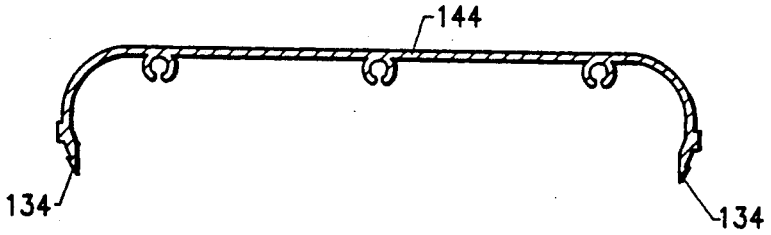
Figure 4:
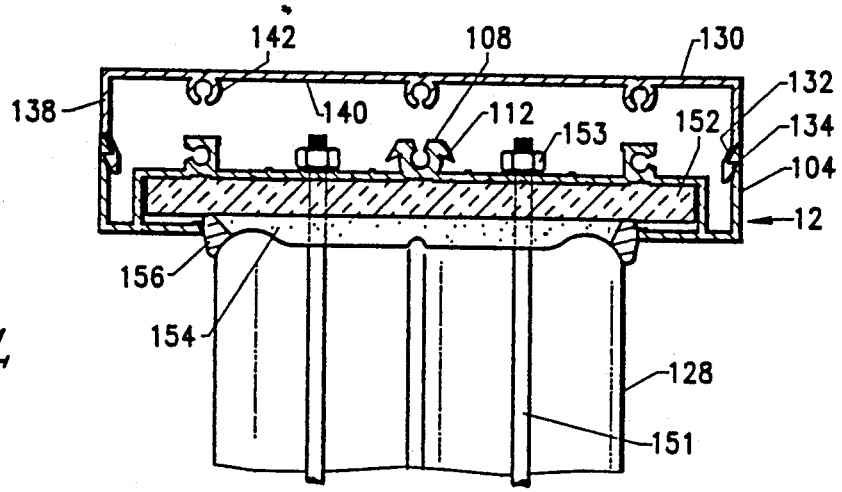

FIG. 4 is a cross sectional view of the interior molding with a connected box cap in a typical finished end of a glass block structure.

FIG. 4*a* is a cross sectional view of a rounded cap that is adapted for coupling to the interior molding of FIG. 4.

FIG. 4*b* is a cross sectional view of a flat cap that is adapted for coupling to the interior molding of FIG. 4.

DETAILED DESCRIPTION OF THE PREFERRED EMBODIMENTS

Figure 1:
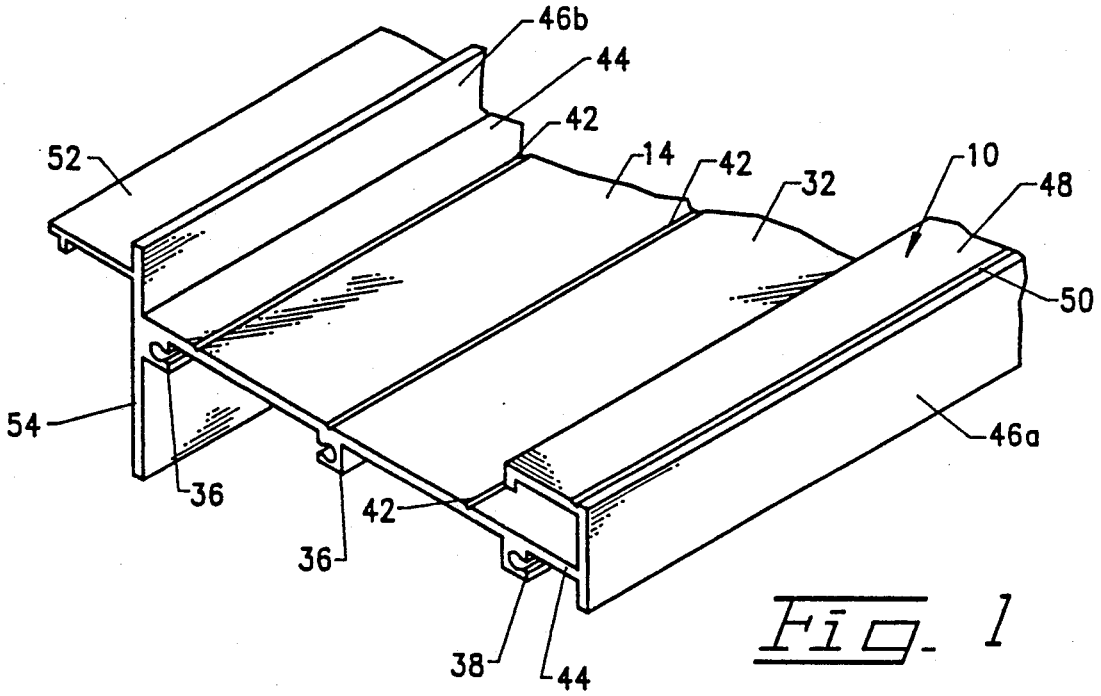
FIG. 1 is a perspective view of an end segment of the exterior molding of this invention.
Figure 3:
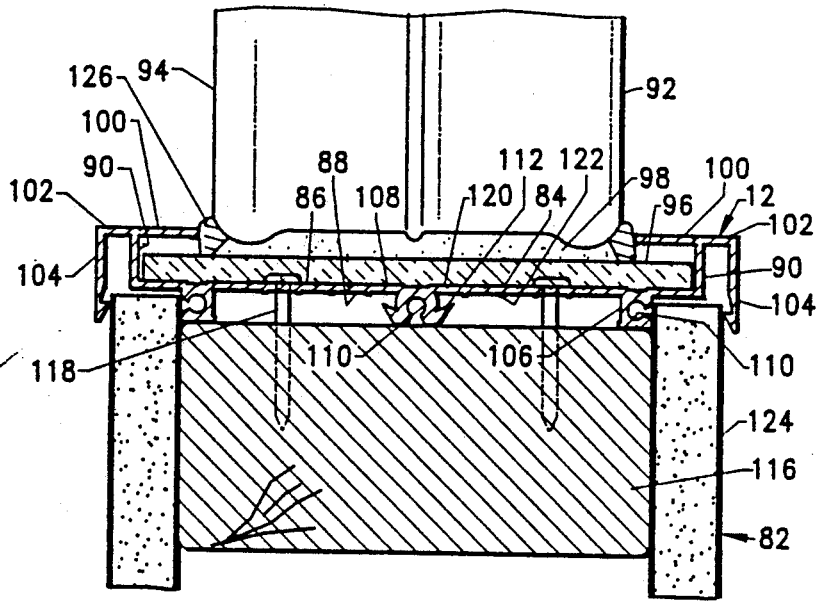

Referring now to FIG. 1 of the drawings, a partial length of the extruded exterior molding designated generally by the reference numeral 10 is shown. The various embodiments of extruded molding of this invention have a uniform cross section throughout the entire length of the molding which typically runs twenty feet. The molding is cut into appropriate lengths generally with mitered ends for forming an encasement into which a glass block structure is erected. The additional embodiments of the molding for glass block structures are shown in cross section only and it is to be understood that the cross sections are uniform along their entire length as in the exemplar of FIG. 1. The exterior molding 10 and an interior molding 12, the latter of which is shown in FIGS. 3 and 4, are comprised of a plurality of angularly disposed elements that make up the unitary molding. The exterior molding 10 and interior molding 12 have certain elements in common and certain elements that distinguish the moldings according to their function in association with particular building structures in which the moldings are used. The moldings 10 and 12 are described with relation to typical building structures of wood frame construction. It is to be understood that these structures are used to aid in the description of the moldings, and the moldings are equally adaptable to other types of structures.

Figure 2:
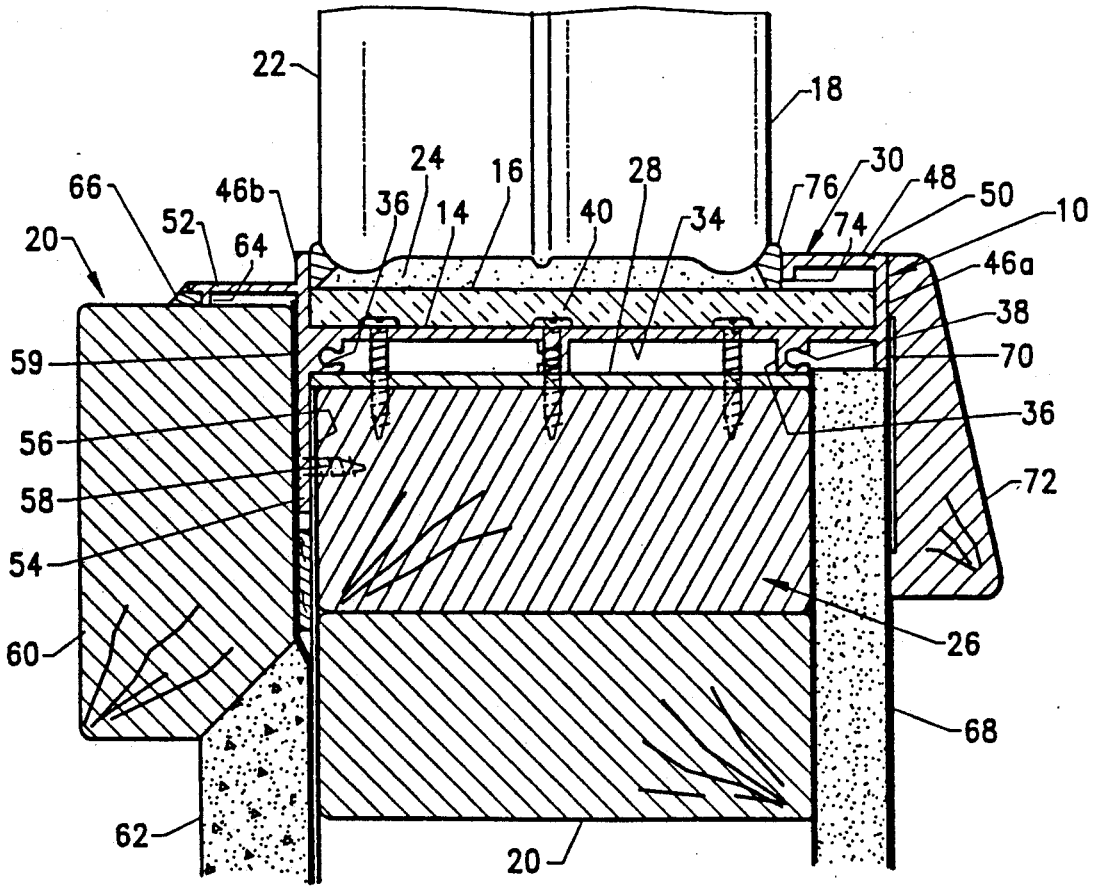
FIG. 2 is a cross sectional view of the exterior molding of FIG. 1 in a typical building structure.

Referring to FIGS. 1 and 2, the exterior molding 10 has a wide, flat, base element 14 on which is supported an insulation pad 16 that is fabricated from fibre glass or closed cell foam to absorb any expansion differentials between the masonry block structure 18 and the wood frame structure 20. The pad is desirably secured to the base element by an adhesive. The block structure 18 is formed by a plurality of blocks 22 (one shown in FIG. 1) that are bonded together by a mortar and seated against the base element 14 and expansion pad 16 with a layer of mortar 24 which fills the irregular space between the glass block and the expansion pad 16. Before installation of the block structure 18, the exterior molding 10 is typically sized interconnected into an encasement and installed in the opening of a wood frame structure 20 and seated against a double two by four frame 26. If necessary shims 28 are wedged between the molding 10 and the frame 26 to insure a tight fit of the installed molding encasement 30.

The base element 14 of the exterior molding 10 has a seating surface 32 on one side on which the block structure and expansion pad are seated and a backing surface 34 from which a plurality of rail members 36 are incorporated. Each of the rail members 36 have an open bore 38 which enable mitered ends of the molding to be screwed together when forming an encasement. The rail members 36 provide a rigidity to the base element 14 as well as a firm support for supporting the base element displaced from the wood frame 26 of the frame structure 20. A series of screws 40 secure the molding to the frame 26. Shallow grooves 42 in the seating surface 32 provide a guide for uniform placement of the screws 40.

At the opposite side edges 44 of the seating surface are perpendicular side elements 46*a* and 46*b* which with the base element form a channel in which the block structure 18 is seated. At least one of the side elements, preferably the side element 46*a* on the interior side of the wood frame structure 20 includes a spacer element 48 that is arranged on the distal end of the side element 46*a* and directed toward the opposite side element 46*b*. The spacer element 48 has a severing groove 50 to permit the spacer element 48 to be broken off the side element 46*a* to accommodate a larger width glass block than that shown in FIG. 2. Glass blocks generally come in two standard widths, one having a width slightly over three inches and the other having a width slightly under four inches. The moldings devised can accommodate both sizes of conventional glass block.

The opposite side element 46*b* is arranged toward the exterior and includes a perpendicular outwardly projecting flash element 52 that provides an effective weather flashing to the molding particularly in its arrangement with a nailing flange that is perpendicularly directed from the backing surface 34 of the base element 14. The flash element 52 provides a sill that displaces water away from the block structure 18. The flange element 54 is secured against the side of the two by four frame 26 over window paper 56 using nails or screws 58. An overlay of building paper 59 provides the necessary weatherizing before an external wood trim molding 60 and stucco finish 62 is applied as an outside finish to the frame structure 20. The flash element 52 has a caulking rib 64 that engages the top of the wood trip 60 and aids in sealing the underside of the flash element 52 when a ceiling bead 66 is applied to the end of the flash element.

Sheet rock 68 is shown applied against the interior side of the wood frame 26. The sheetrock abuts an extension element 70 that extends from the backing surface 34 of the base element 14 in the same plane as the side element 46a. Interior wood trim 72 finishes the inside surface of the wood frame structure 20. If desired, spacer elements 48 that have been removed from the molding 10 can be used as a nailing flange for the interior side of the frame structure 20. The spacer element 48 includes an end hook 74 that is engageable in the bore 38 of the rail member 36 on the interior side of the molding. With the hook element 74 engaged the spacer element is nailed against the wood frame 26 holding down the molding.

The glass block 22 are placed on a mortar bed 24 which sets on the expansion pad 16 with a sealant bead 76 sealing a space between the glass block and the molding.

The wood frame structure 20 shown in FIG. 2 is a typical type of structure that can be used in conjunction with the glass block molding of this invention. Other arrangements and materials are equally suitable for use in combination with the devised molding.

In a similar manner, the glass block structure molding 12 that is primarily suitable for interior structures, is shown in FIG. 3 seated against a wood frame, interior wall structure 82. The interior molding 12 also has exterior uses and may be used indoors and outdoors when capping a glass block structure such as that shown in FIG. 4. It is to be understood that while the interior molding 12 is shown in cross section, the molding is an elongated strip of uniform cross section of the type shown in FIG. 1. Interior molding 12 has a base element 84 with a seating surface 86 and a backing surface 88. At each of the side edges of the wide flat base element 84 are perpendicular side elements 90 which with the base element 84 form a channel for the glass block 92 of a block structure 94.

At the expansion pad 96 is seated on the seating surface of the base element and the glass block 92 sets against a layer of mortar 98 at a distal ends of the side elements 90 are spacer elements 100 which can be removed by breaking the spacer elements 100 away from the side elements 90 to accommodate a larger width block. The use of two spacer elements 100 in the interior molding is designed to position the block structure at the center of the molding for aesthetics. In the exterior molding 10, a single spacer element is used to position the block structure as far to the exterior as possible. At the end of the side elements 90 on the interior molding 12 are perpendicular sill elements 102 in the same plane as the spacer elements 100. The sill elements 102 support at their distal ends, trim elements 104 that are perpendicular to the sill elements and directed back parallel with the side elements 90.

On the backing surface are rail members 106 and 108 each having a bore 110 for securing mitered ends of the molding together when constructing an encasement. The rail members 106 and 108 also provides stiffening to the interior molding 12 and the center rail member 108 includes interlocking means 112 for coupling a cover plate 114 as shown in FIG. 4b and described hereafter. The rail members seat on a wood frame 116 and are secured thereto by screws or nails 118. The seating surface 86 has a series of small grooves 120 for uniform placement of the nails and the backing surface 88 has a series of small ribs 122 for stiffening between the preferred nail locations. A wall structure 82 is finished with sheet rock 124 that can be tucked under the trim elements 104 to provide a neat finished appearance to the wall structure. The joint between the glass block structure and the molding can be filled with a grout or a bead of sealant 126 that abuts backing element 101.

While the wall structure 82 of FIG. 3 is typical for the intended interior use of the interior molding 12, the molding 12 also can be employed to cap an exposed end or top of a glass wall structure as shown in FIG. 4. Referring to FIG. 4, a glass wall structure 128, for example a low divider between two rooms, utilizes the interior molding 12 as the base structure for an ornamental cap 130. As shown, the ends of the trim elements have locking hooks 132 which engage similar locking hooks 134 on the cap 130. The units 130 of FIG. 4 is of a box construction and includes a flat top elements 136 and two side element 138 at the ends of which are located the locking hooks 134. The cap 130 has an underside 140 with bead members 142 that received the screws when joining mitered ends. The box style cap 130 shown in FIG. 4 can be replaced by a similarly constructed rounded cap 144 as shown in FIG. 4a or the flat cap plate 114 as shown in FIG. 4b. The rounded cap unit 144 is particularly suitable for hand rails and the like and the flat plate 114 is particularly suitable where a wood cover is incorporated over the molding 12. The flat plate 114 has additional locking hooks 148 in the center of the plate to engage locking hooks 150 on center rail 108 to secure the plate 114 to the interior molding 12. With the flat plate 114 the interior molding 12 forms a firm base for additional of an auxiliary structure as railings, a wood cap or other such structure. Where necessary, suitable anchoring such as the elongated one quarter inch diameter rod elements 151 incorporated between blocks in the glass block structure 128 with the molding 12 secured to the rod by nuts 153 which seat on the ribs 122. The ribs 122 provide a means for identifying the place where there is adequate mortar between blocks. In the larger size block the anchor rods would be positioned between the next outward pair of ribs. Also, seating means other than the expansion pad 152 and mortar bed 154 with edge sealant 156 can be used where required for a more substantial structural support. For example, the expansion pad can be eliminated and the molding 12 seated on a thicker bed of mortar. The expansion pad can also be eliminated for both the interior and exterior moldings 10 and 12 in the section of molding that is used in the sill of an encasement, such that a block structure rests on an incompressible base.

The various moldings shown and described can be used in a variety of different structures which incorporate the use of glass building block. The examples of typical structures shown herein is not intended to limit the types of glass block structure that can be constructed for advantageous incorporation of the moldings described.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An extruded molding adapted to form a perimeter frame around wall structures of glass masonry block of two standard width sizes, the molding comprising a unitary, elongated extrusion formed with a wide, flat, base element having a seating side, a backing side and outside edges with flat side, elements projecting from the side edges of the seating side perpendicular to the base element, wherein a channel is formed in which a glass block structure of a first standard width is adapted to be seated, wherein at least one of the flat side elements has a distal end with a spacer element perpendicular to the side element directed toward the opposite side element with means for breaking the spacer element off the side element to accommodate glass block in the channel of a second standard width greater than the first standard width, and wherein the backing side of the base element includes a plurality of stiffening rails having bore means for interconnecting mitered ends of the molding into a rigid, continuous perimeter frame and for supporting the molding against a building structure.

2. The extruded metal molding of claim 1 wherein one of the flat side elements has a flat flash element perpendicular to the side element directed away from the opposite side element for diverting water away from the molding when the molding is used to frame a glass block structure with an exterior exposure.

3. The extruded molding of claim 2 wherein the molding includes a flat flange element perpendicular to the flash element projecting from the blacking side of the base element, the flange element being arranged to face against a frame member of a building structure for attachment thereto by securing means when the molding is supported against the building structure, the flange element and flash element cooperating to prevent water seepage into the building structure.

4. The extruded molding of claim 3 in combination with an expansion pad that is supported on the seating side of the base element of the molding, against which glass masonry block is able to be set on a layer of mortar to form the glass block wall structure.

5. The extruded molding of claim 1 wherein both of the flat side elements have a distal end with a spacer element perpendicular to the side element and directed toward one another, the spacer elements having means for breaking the spacer elements off the side elements to accommodate glass block in the channel of the second standard width.

6. The extruded molding of claim 5 wherein the side elements each have at their distal end, a flat sill element perpendicular to the side element, the sill elements being directed away from the spacer elements in a common plane, the sill elements each having an outer end with a trim element perpendicular to the sill element directed back alongside and spaced from the side element.

7. The extruded molding of claim 5 in combination with a capping unit wherein the trim elements have an end edge with a connecting element and the capping unit has side edges with connecting means for engaging the connecting elements on the ends of the trim elements for coupling the capping unit to the molding when the molding is used as an edge capping for the exposed edge of a glass block structure.

8. The extruded molding of claim 7 wherein the capping unit comprises a flat plate.

9. The extruded molding of claim 8 wherein the capping unit comprises a rectangular channel structure.

10. The extruded molding of claim 9 wherein the capping unit comprises a rounded channel structure.

11. An extruded molding adapted to form a perimeter frame around wall structures of glass masonry block, the molding comprising a unitary, elongated extrusion formed with a wide flat base element having a seating side, a backing side and outside edges with flat side elements projecting from the side edges of the seating side, perpendicular to the base element, wherein a channel is formed in which a glass block structure having a standard width is adapted to be seated, wherein one of the side elements has a flat flash element perpendicular to the side element directed away from the opposite side element for diverting water away from the molding when the molding is used to frame glass block with an exterior exposure and a flat flange element perpendicular to the flash element projecting from the backing side of the base element, the flange element being arranged to face against a frame member of a building structure for attachement thereto by securing means when the molding is supported against the building structure.

12. The extruded molding of claim 11 comprising further a flat flange element perpendicular to the flash element projecting from the backing side of the base element, the flange element being arranged to face against a frame member of a building structure for attachment thereto by securing means when the molding is supported against the building structure.

13. The extruded molding of claim 11 in combination with an expansion pad that is supported on the seating side of the base element of the molding against which glass masonry block is set on a layer of mortar to form a glass block wall structure.

14. The extruded molding of claim 11 wherein the side element opposite the side element including the flash element has a distal end with a flat spacer element perpendicular to the side element and directed at the opposite side element, the spacer element having means for breaking the spacer to accommodate glass block of greater width in the channel.

15. The extruded molding of claim 14 wherein the base element includes on its backing side a plurality of stiffening rails, the stiffening rails each having a bore means engageable by screws for interconnecting mitered ends of the molding.

16. The extruded molding of claim 15 wherein one of the stiffening rails is located at the outside edge of the base element, the rail having a bore with a side opening and wherein the spacer element has an edge with a hook element which, when the spacer element is removed from the side element, is engageable in the bore, the spacer element being adaptable as a nail flange against a frame member of a building structure.

* * * * *